US005261620A

United States Patent [19]

Holzinger et al.

[11] Patent Number: 5,261,620

[45] Date of Patent: Nov. 16, 1993

[54] POPE ROLL WINDER HAVING DIRECT DRIVE

[75] Inventors: Dieter Holzinger, Herbrechtingen; Roland Moller; Karl Ruck, both of Heidenheim, all of Fed. Rep. of Germany

[73] Assignee: J. M. Voith GmbH, Fed. Rep. of Germany

[21] Appl. No.: 837,734

[22] Filed: Feb. 19, 1992

[30] Foreign Application Priority Data

Mar. 30, 1991 [DE] Fed. Rep. of Germany ..... 41105052

[51] Int. Cl.[5] ..... B65H 18/16

[52] U.S. Cl. ..... 242/65

[58] Field of Search ..... 242/65, 66

[56] References Cited

U.S. PATENT DOCUMENTS

| | | | |
|---|---|---|---|
| 3,075,719 | 1/1963 | Hornstein et al. | 242/65 |
| 3,202,374 | 8/1965 | Phelps | 242/65 |
| 3,743,199 | 7/1973 | Karr et al. | 242/65 |
| 4,634,068 | 1/1987 | Malkki et al. | 242/65 |
| 4,809,920 | 3/1989 | Bächinger et al. | 242/66 X |
| 4,858,843 | 8/1989 | Gierse et al. | 242/66 X |
| 4,934,619 | 6/1990 | Snygg | 242/65 X |
| 5,012,987 | 5/1991 | Dropczynski et al. | 242/66 X |
| 5,184,787 | 2/1993 | Holzinger et al. | 242/65 |

*Primary Examiner*—Clifford D. Crowder
*Assistant Examiner*—John J. Calvert
*Attorney, Agent, or Firm*—Baker & Daniels

[57] ABSTRACT

A winder for winding a running web of paper, foil or similar. A support drum of web width is provided, and a winding drum on which the web is wound to a roll. A pair of primary swivel levers each feature on one end a fork for receiving a winding drum bearing and is mounted with its other end in the region of the support roll axis in such a way that the winding drum, in swiveling from a first position above the support roll, will in the running direction of the web approach the support roll while moving around it, passing in the process a primary section until reaching a second position. The winding drum with the still unfinished paper roll is taken over by a pair of secondary swivel levers with an essentially horizontal guideway extending from the second position across a secondary section up to a third position. A contact device forces the winding drum onto the support roll, and a drive is coordinated with the winding drum. A slide features guideways for guidance of the drive as it passes through the primary section, and is connected with the primary levers in such a way that it also will perform their swivel movement. A connecting link guide adjusts the radial position of the slide according to the current paper roll diameter, and ensures the slide tracking according to the increase in paper roll diameter. A guide rod clutch is arranged between the drive and the winding drum.

4 Claims, 2 Drawing Sheets

POPE ROLL WINDER HAVING DIRECT DRIVE

BACKGROUND OF THE INVENTION

The invention concerns a winder for winding a running web of paper, foil and the like. Also called "Pope Rollers," such winders form generally the end section of a paper machine, imparting a roll shape to the paper web accruing there. They are also used to rewind an already finished roll so as to create a new roll.

In either case, the roll is to have very specific properties, specifically with regard to the winding hardness. Beginning with a certain initial value, the winding hardness is supposed to drop to an end value. The drop should be maximally uniform from the first to the last lap. It is to have a certain gradient, i.e., not too severe and not too weak. The pattern of winding hardness should at any rate not have points of abrupt change, for instance a sudden drop.

All of this has been sought heretofore but not accomplished. Instead, winders of prior design produce rolls where the core is extremely hard. As a result, this core is unusable because the web is overstretched in this region and breaks, so that this part needs to be discarded as scrap.

Prior means for influencing the winding hardness are two measures used, e.g., on rotary slitters. One is constituted by subjecting the web in winding to a more or less heavy tension. The other measure is forcing the roll more or less heavily on the support roll, for instance by application of pressure on the axles of the winding drum, or by contact with a rider roll which is arranged parallel to the roll being created and is forced onto it creating a line pressure between the paper roll and the support roll.

A line pressure is frequently created in the said primary section, by the weight of the winding drum, between the paper roll being created and the support roll. The winding drum is extremely heavy, reaching a dead weight of several tons, so that an appropriately high line pressure is created. The latter is responsible for the extremely high winding hardness of the core of the paper roll.

Providing a drive of its own for the winding drum, i.e., a so-called center drive, is advantageous because it allows managing the winding hardness still the best. In this arrangement, the said slide (or slide pair) including the guideways is mounted on a swivel arm, so that the slide performs the same swivel movement as the primary levers.

Since the paper roll grows as it passes the primary section, i.e., its diameter increases, also the radial distance between the drive and the axis of the support roll must be enlarged at the same ratio. Serving this purpose is the adjustment of the radial position (tracking) of the slide. The tracking has so far been realized by means of a hydraulic control where the distance between the drive slide and the winding drum is continuously measured while passing through the primary section, and the slide tracking is accomplished by means of two hydraulic cylinders. Such a control is expensive. As a further aggravation, the weight of motor and gear set needs to be compensated for.

The problem underlying the invention is giving the radial adjustment, or tracking, of the slide a design such that it will be simple in structure, that also certain tolerances may be allowed regarding the control accuracy, and that it will work reliably.

SUMMARY OF THE INVENTION

This problem is solved by the features of the present invention. The present invention, in on form thereof, comprises a winder for winding a running web of paper, foil or similar. A support drum of web width, and a winding drum on which the web is wound to a roll are provided. A first pair of swivel levers (primary levers) features each on one end a fork for receiving a winding drum bearing, and are mounted with the other end in the region of the support roll axis in such a way that the winding drum, in swiveling from a first position above the support roll, will in the running direction of the web approach the support roll while moving around it. In the process a primary section is passed until a second position is reached in which the winding drum with the still unfinished paper roll is taken over by a second pair of swivel levers (secondary levers), with an essentially horizontal guideway extending from the second position across a secondary section up to a third position. A contact device forces the winding drum with the paper roll being created on it onto the support roll. A drive (motor or, as the case may be, gear set) is coordinated with the winding drum, with a slide featuring guideways for guidance of the drive as it passes through the primary section, and connected with the primary levers in such a way that it also will perform their swivel movement, with a device for adjusting the radial position of the slide according to the current paper roll diameter (radial adjustment). Provided as radial adjustment is a connecting link guide ensuring the slide tracking according to the increase in paper roll diameter. A guide rod clutch is arranged between the drive and the winding drum.

In one preferred embodiment, the radial adjustment may be by means of a connecting rod guide as well as a guide rod clutch between the drive and the winding drums in the secondary section. In another embodiment, for the radial adjustment in the secondary section a guide lever may be provided which is coupled with the secondary levers and attaches to the slide in the axis of rotation of the winding drum. In yet another embodiment, the connecting rod is adjustable in view of varying paper roll building velocities and swivel velocities of the levers.

In the case of high-speed, single-purpose machines, the production capacity ranges within very narrow limits. Consequently, the velocity of increase of the paper roll diameter can be determined with a definable tolerance, making it possible to fix the connection link guide once and for all. It is also conceivable, however, to make the connection link guide exchangeable or to design it in such a way that it will be variable as desired.

The remaining tolerance is balanced by a guide rod clutch coordinated with the drive and, due to its structure, having low restoring forces. The restoring forces of the clutch increase proportionately to the deflection. But due to using the connecting link guide, only a deflection range is needed that generates forces so low that they will have no disturbing effect on the line force of the paper roll.

The said guide rod clutch is generally arranged between the drive and the winding drum. But if the motor, due to a special design (for instance transversal flux motor), is directly coordinated with the winding drum, the guide rod clutch can be arranged also between the motor and gear set.

Furthermore, a pneumatic cylinder may be provided which acts on the slide ensuring that it always follows the connecting link guide.

In the secondary section, the slide tracking is accomplished by means of a lever coupled to the secondary levers. By using low friction ball guides, the friction forces of the slide are so low that they will have no adverse effect on the line force of the paper roll, and thus on the winding hardness.

The guide rod clutch is essentially designed as follows: it comprises a first clutch half rotating with a driving part, a second clutch half rotating with a driven part, a first intermediate clutch element, a second intermediate clutch element and a third intermediate clutch element. The first intermediate clutch element may be connected with the driving clutch half through a first connecting rod and through a second connecting rod, situated diametrically opposite the first connecting rod, with the driven clutch half. The second intermediate clutch element may be connected with the driving clutch half through a third connecting rod and with the driven clutch half through a fourth connecting rod situated diametrically opposite the third connecting rod. The third intermediate connecting element is suitably connected with the driving clutch half through a fifth connecting rod and through a sixth connecting rod with the driven clutch half.

A guide rod clutch according to DE 37 32 705 A1 is suitable. A clutch of such category is a universally movable, nearly torsionally rigid clutch suited for connecting two machine parts which are upwardly, radially, axially or angularly offset relative to each other.

BRIEF DESCRIPTION OF THE DRAWINGS

The invention will be more fully explained with the aid of the drawing, which in detail shows the following.

DESCRIPTION OF THE PREFERRED EMBODIMENT

Figure 1:
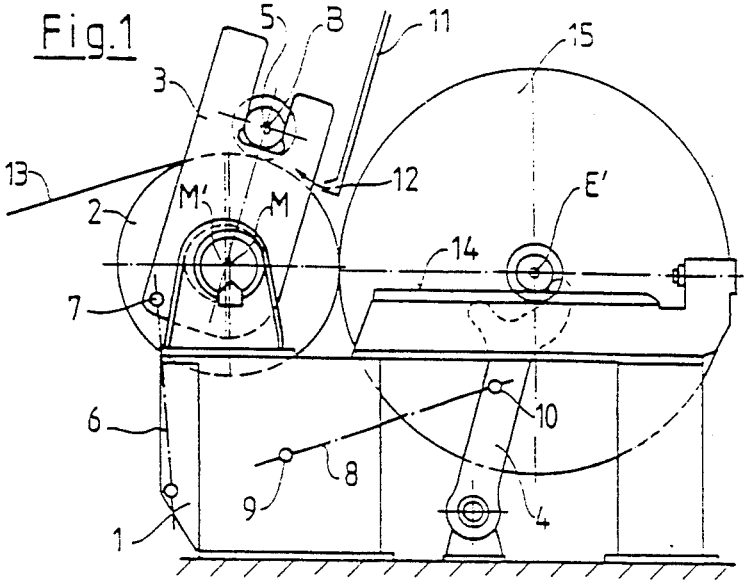
FIGS. 1 through 3 illustrate a pope roller in three different operating phases winding a so-called LWC paper.
Figure 2:
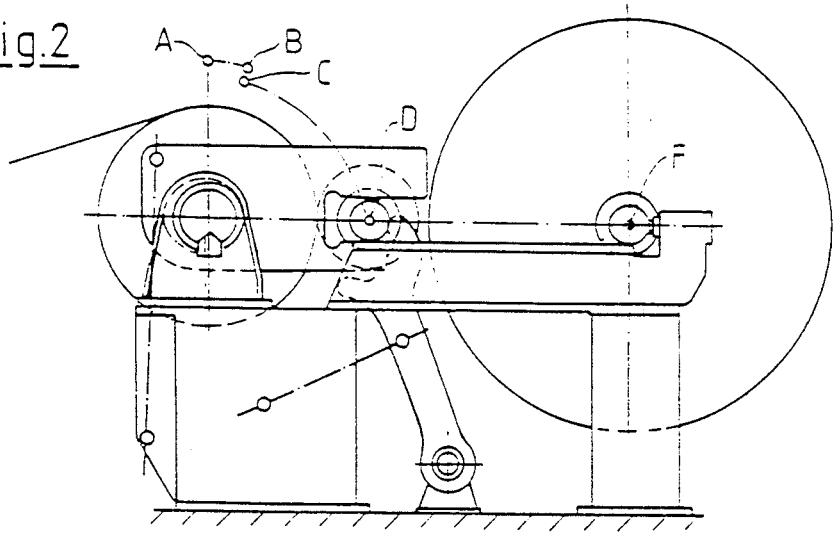
Figure 3:
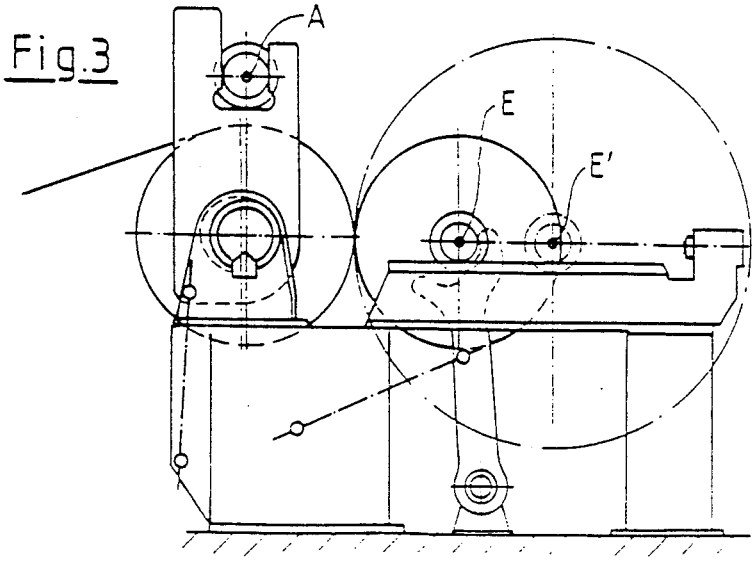

FIG. 1 shows the operating phase in which a paper roll 15 has been finished and a new paper roll is to be started. On a machine frame 1 are mounted a support drum 2, two primary levers 3, and two secondary levers 4. Each of the two pairs of primary and secondary levers 3 and 4 has a fork at its upper end. The levers of a pair are spaced apart across the machine. Within each fork at each lateral side a corresponding journal pin of a winding drum 5 is received. The two primary levers 3 are parallel and locked together to move together. The levers 3 have a swing drive 6, which is indicated diagrammatically by a dot-dash line and which may in practice also comprise a pneumatic unit. The swing drive 6 acts on the primary levers 3, at an articulation 7 on the levers 3.

There is a slight eccentricity between the axis of rotation M of the support drum 2 and the center of the swing M′ of the primary levers 3. This eccentricity, however, need not be present. Due to the special development of the invention, namely the possibility of the radial positioning of the winding drum 5, the axis of rotation M of the support drum 2 and the center of swing M′ of the primary levers 3 could also coincide.

There is a second swing drive 8 associated with the two secondary levers 4 which also are parallel and locked together to swing together. One end of the drive 8 is mounted on a bearing 9 on the machine frame 1, and the other end of the drive 8 acts on an articulation 10 on the secondary levers 4.

A blast line 11 with blow nozzles 12 serves for blowing into place to start the winding of the starting end of the web of paper 13 onto the winding drum 5. In the machine frame 1 there is a horizontal travel path 14 on which the reel 15 is supported as it is moved along the secondary path by means of the journal pins of the winding drum 5. The roll 15 is contained in the position E′, while the winding drum 5 is in position B.

On the way from position A to B, the winding drum 5 has already been powered, by a center drive, to the speed of rotation of the support drum 2, but only in the opposite direction. In position B, the winding drum is then somewhat lowered radially, to the position C, so that it will make contact with the shell surface of the support drum 2, for purposes of winding the web 13. The leader of web 13, approaching from the left, is wound on the winding drum 5 by means of blow nozzles 12.

On the way from C through D and up to E′, the winding drum, or the paper roll being created, is in contact with the shell surface of the support drum. Between D and E, additionally, the center drive is operationally imparting a torque to the winding drum 5. Upon moving the finished paper roll 15 in the position F, also the winding drum 5 with the new paper roll proceeds to the position D. Until reaching the position E, the paper roll being created is driven both by frictional entrainment, on the support drum 2, and by the center drive. Only in the last phase, between E and E′, is the paper roll driven merely by contact with the support drum 2, and thus by frictional entrainment.

Figure 5:
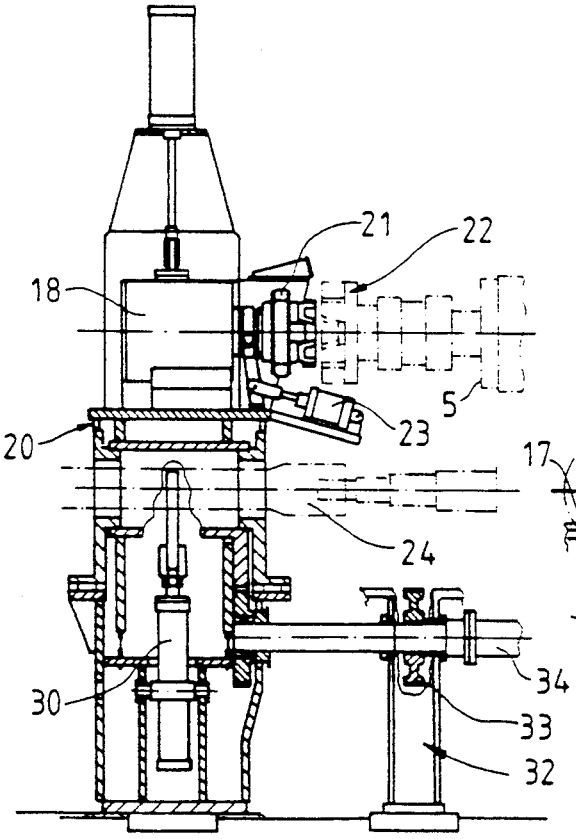
FIG. 5 illustrates the drive side components of the pope roller according to FIG. 4, as a sectional view according to section line A—A in FIG. 4.
Figure 4:
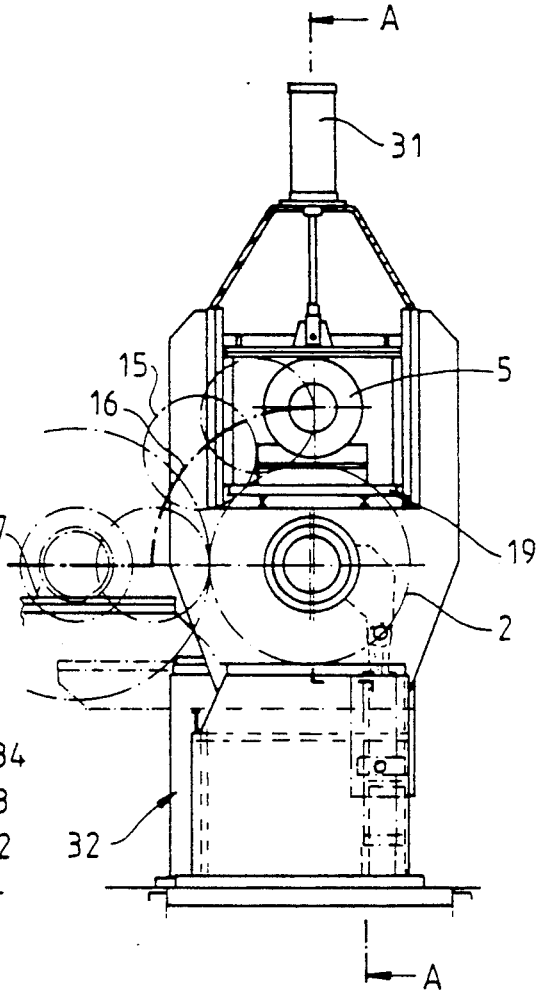
FIG. 4 illustrates a pope roller in side elevation viewed from the drive side.

The pope roller according to FIG. 4 and 5 again features the following major components: a support drum 2, a winding drum 5 with a paper roll 15 contained on it. The latter is illustrated in FIG. 4 by dash-dot line, in such a way that the individual phases of its creation can be recognized. As can be seen, its diameter increases while the center of the paper roll 15 moves on a curved path 16 around the support drum 2, passing through a primary section until reaching a position D. Here, the paper roll 15 is taken over by not illustrated secondary levers and moves on an essentially horizontal path 17 away from the support drum 2 while continuing to be wound and, finally, reaching its finished diameter.

Coordinated with the winding drum is a contact device forcing it, with the growing paper roll contained on it, on the support drum. Moreover, a drive motor 18 is coordinated with the winding drum 5. The motor rests on a slide 19 featuring guideways for guiding the motor 18 as it passes through the primary section. The slide is connected with the not illustrated primary levers in such a way that it will perform their swivel movement.

According to the invention, a connecting link guide 20 is provided as radial adjustment of the slide. With the aid of this connecting link guide, the slide 19, on its way through the primary section, tracks in keeping with the increase of the paper roll diameter.

According to the invention, moreover, a guide rod clutch 21 is arranged between the drive motor 18 and the winding drum, additionally a winding drum clutch 22 which is actuated by a control cylinder. A drive 24 is coordinated with the support drum 2. Further components of this pope roller are a swivel cylinder 30 for actuation of the primary levers, a cylinder 31 exerting the contact pressure on the winding drum and thus also on the support drum, a frame 32 for drum support, a gearing 33 to the primary lever, and a parallel guide shaft 34.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A winder for winding a running web into a roll, comprising:

a support drum, said support drum having a width substantially the same as the width of the web and having an axis;

a winding drum on which the web is wound into the roll;

a primary and a secondary pair of swivel levers, each of said primary swivel levers having a fork on one end for receiving a bearing of said winding drum, and being mounted with the other end at an axis having a slight eccentricity with said axis of said support drum in such a way that the winding drum, in swiveling from a first position above the support drum, will in the running direction of the web approach the support drum while moving around said support drum, passing in the process a primary section until reaching a second position in which the winding drum with an unfinished web roll is transferable to said secondary pair of swivel levers;

a generally horizontal guideway extending from the second position across a secondary section to a third position;

a contact device for forcing the winding drum with the roll being wound thereon onto the support roll;

a drive for the winding drum;

a slide having guideways for guidance of the drive as the drive passes through the primary section, and connected with the primary levers in such a way that the drive swivels said primary levers;

means for adjusting the radial position of said slide relative to the wound roll according to the diameter of the wound roll, said means for adjusting comprising a connecting link guide operable to ensure that said slide tracks according to an increase in diameter of the wound roll; and a guide rod clutch arranged between the drive and the winding drum.

2. The winder of claim 1, wherein said means for adjusting and said guide rod clutch are in said primary section, and further including additional means for adjusting said connecting link guide and an additional guide rod clutch in said secondary section.

3. The winder of claim 2, in which said means for adjusting in said secondary section comprises a guide lever, wherein said guide lever is coupled with said secondary levers and attaches to said slide in the axis of rotation of said winding drum.

4. The winder of claim 1, including means for adjusting said connecting link guide in view of varying building velocities of said roll, and swivel velocities of said primary levers.

* * * * *